US009638420B2

(12) United States Patent
Li

(10) Patent No.: US 9,638,420 B2
(45) Date of Patent: May 2, 2017

(54) CYCLONE IGNITION GUN

(71) Applicant: Yi-Jue Li, Taipei (TW)

(72) Inventor: Yi-Jue Li, Taipei (TW)

( * ) Notice: Subject to any disclaimer, the term of this patent is extended or adjusted under 35 U.S.C. 154(b) by 296 days.

(21) Appl. No.: 14/530,755

(22) Filed: Nov. 2, 2014

(65) Prior Publication Data

US 2016/0123590 A1 May 5, 2016

(51) Int. Cl.
*F23Q 13/04* (2006.01)
*F23Q 2/16* (2006.01)
*F24B 15/00* (2006.01)

(52) U.S. Cl.
CPC ..... *F23Q 13/04* (2013.01); *F23Q 2/16* (2013.01); *F24B 15/005* (2013.01)

(58) Field of Classification Search
CPC ..... F23Q 13/04
USPC ..... 431/153, 257
See application file for complete search history.

(56) References Cited

U.S. PATENT DOCUMENTS 3,545,902 A * 12/1970 Bailey ..... F23D 11/001 431/116
3,949,921 A * 4/1976 Brack ..... B25C 1/085 227/9
5,285,967 A * 2/1994 Weidman ..... B05B 7/205 239/132.1
5,678,494 A * 10/1997 Ulrich ..... F23G 5/027 110/102
6,508,645 B1 * 1/2003 George ..... F23D 14/36 431/187
6,544,210 B1 * 4/2003 Trudel ..... A61B 18/00 604/26
6,983,550 B1 * 1/2006 Lin ..... F23D 14/18 34/96
2005/0029323 A1 * 2/2005 Shima ..... B25C 1/08 227/10
2006/0236557 A1 * 10/2006 Bousfield ..... A45D 20/06 34/96
2008/0230044 A1 * 9/2008 Warner ..... A47J 37/079 126/25 B

* cited by examiner

*Primary Examiner* — Avinash Savani
(74) *Attorney, Agent, or Firm* — Pai Patent & Trademark Law Firm; Chao-Chang David Pai

(57) ABSTRACT

A cyclone ignition gun includes a housing, an igniter, an electric fan, a battery pack, a gas can and a duct pipe respectively mounted inside the housing, a slide switch mounted in the top side of the housing for controlling the operation of the igniter and the electric fan, and a push switch mounted in the bottom side of the housing for controlling the gas can to discharge gas for burning. The slide switch and the push switch can be simultaneously operated to selectively achieve the function of fire burning and air blowing, the function of fire burning, or the function of air blowing.

14 Claims, 8 Drawing Sheets

CYCLONE IGNITION GUN

BACKGROUND OF THE INVENTION (a) Field of the Invention

The present invention relates to ignition gun technology and more particularly, to a cyclone ignition gun for igniting charcoal, wood or coal, etc. which is operable to selectively achieve the function of fire burning and air blowing, the function of fire burning, or the function of air blowing.

(b) Description of the Prior Art

Ignition gun is commonly used in houses for igniting the fireplace, candles, or barbecue charcoals. However, commercial ignition guns can simply achieve the function of fire ignition without any air blowing effects.

When using an ignition gun to ignite combustible substances (charcoal, wood or coal, etc.), the weak firepower cannot ignite the combustible substances rapidly. For example, when burning charcoal or coal in a barbecue stove, it needs to continuously supply air (oxygen) after burning of fire sticks. Sometimes an air blower should be used to supply oxygen for burning. This operation manner is quite time-consuming and inconvenient.

SUMMARY OF THE INVENTION

The present invention has been accomplished under the circumstances in view. It is therefore the main object of the present invention to provide a cyclone ignition gun, which comprises a housing, an igniter, an electric fan, a battery pack, a gas can and a duct pipe respectively mounted inside the housing, a slide switch mounted in the top side of the housing for controlling the operation of the igniter and the electric fan, and a push switch mounted in the bottom side of the housing for controlling the gas can to discharge gas for burning. The slide switch and the push switch can be simultaneously operated to selectively achieve the function of fire burning and air blowing, the function of fire burning, or the function of air blowing. Thus, the operation of the present invention is very simple and labor-saving.

Preferably, the electric fan comprises a motor and a fan blade unit. Further, the duct pipe has a rear end thereof provided with a hood and attached to an air output side of the fan blade unit of the electric fan, and an opposing front end thereof extending out of a front side of the housing. The rear end of the duct pipe has a plurality of air outlets spaced around the periphery for generating a cyclone to strengthen flame burning.

Preferably, the slide switch is a composite switch for controlling the operation of the igniter and said electric fan, having a return spring mounted at a front side thereof. Thus, the slide switch is normally disposed in a middle position where the igniter and the electric fan are off. Pushing the slide switch forwardly from the middle position to a front-end position can start up the igniter to ignite fire. Pushing the slide switch backward from the middle position to a rear-end position can start up the electric fan to blow air. When released the hand from the slide switch, the slide switch is automatically returned to the middle position by the return spring to turn off the igniter and the electric fan.

Preferably, the push switch is equipped with a compression spring. Thus, the user must press the push switch and hold it in the pressed condition so that the gas can be kept open to continuously supply gas for burning. When released the pressure from the push switch, the valve of the gas can will be closed automatically to cut off the supply of gas. Therefore, the push switch is a safety switch for controlling the supply of gas, preventing accidental gas discharge and assuring a high level of safety.

DETAILED DESCRIPTION OF THE PREFERRED EMBODIMENTS

Figure 1:
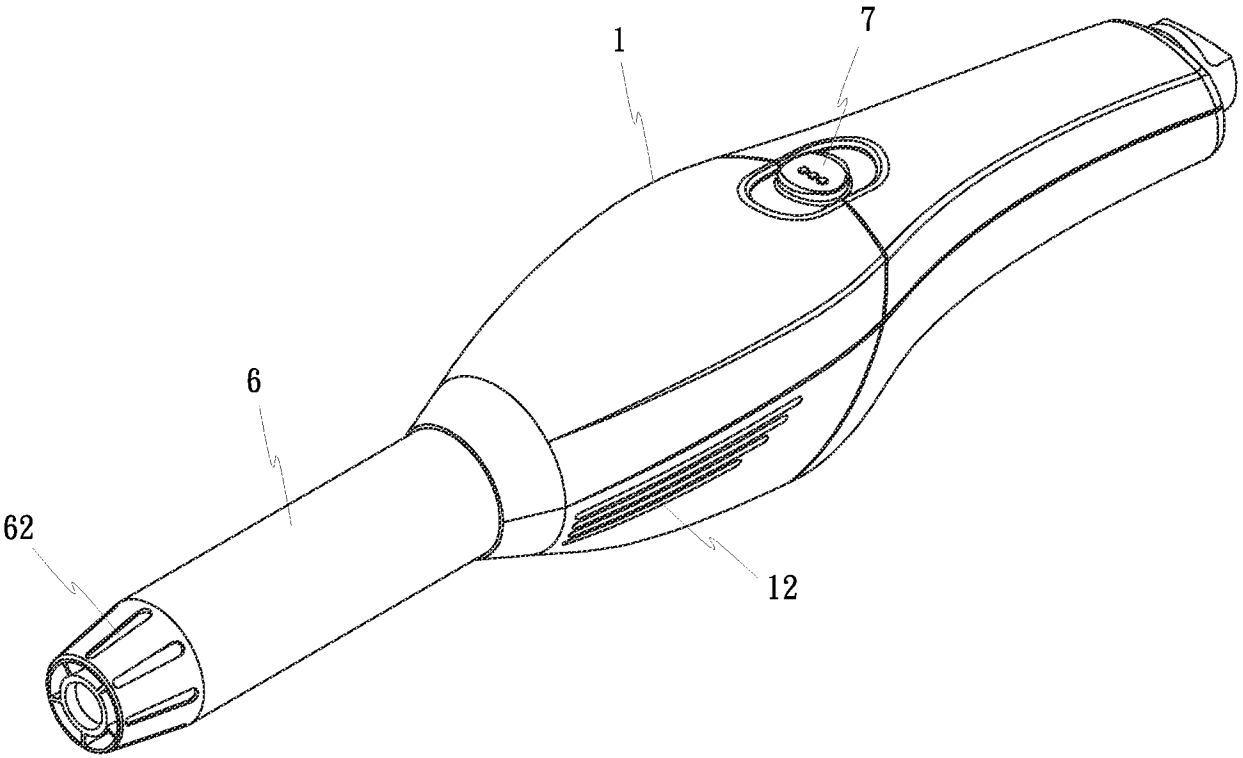
FIG. 1 is an oblique top elevational view of a cyclone ignition gun in accordance with the present invention.
Figure 2:
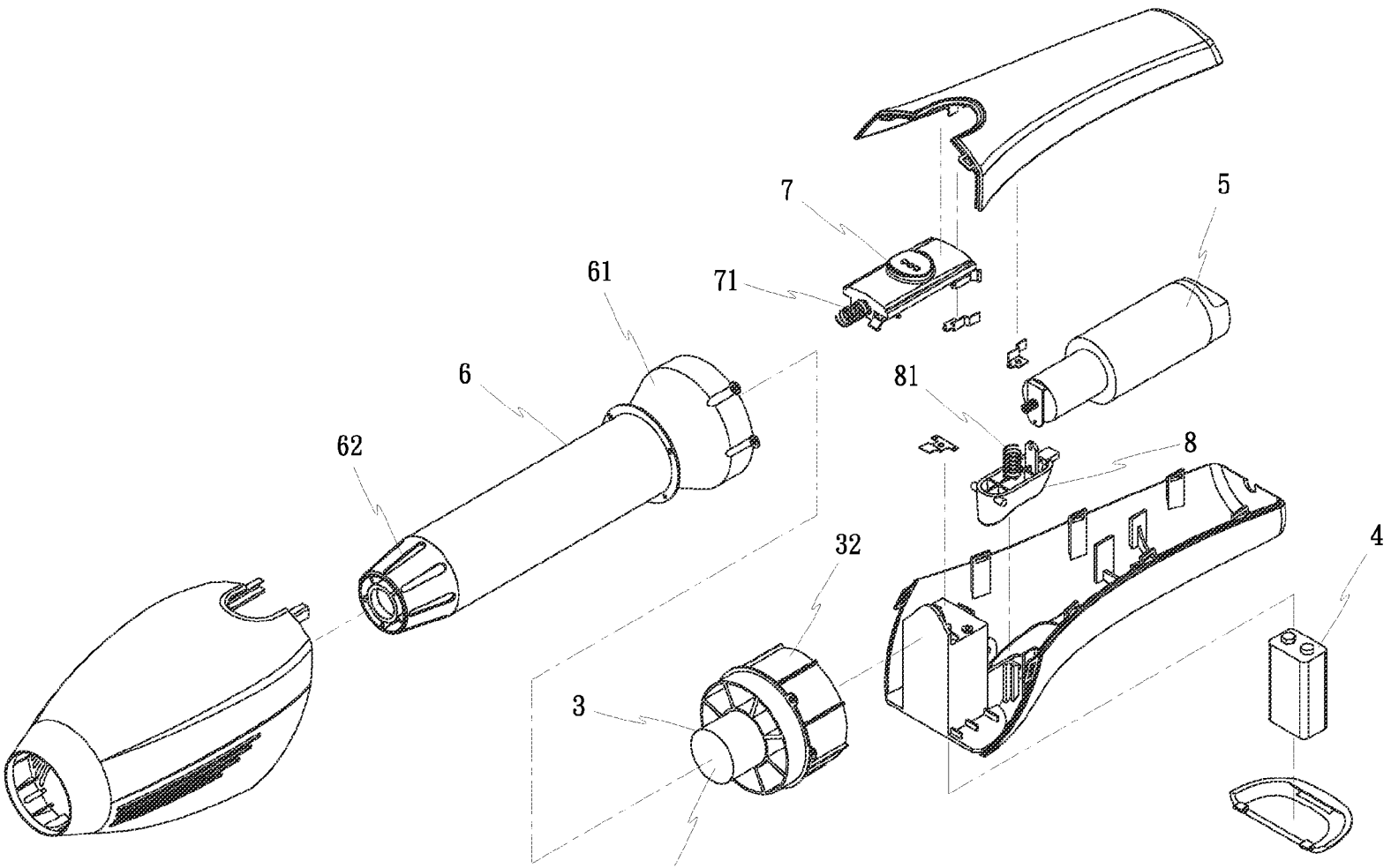
FIG. 2 is an exploded view of the cyclone ignition gun in accordance with the present invention.
Figure 3:
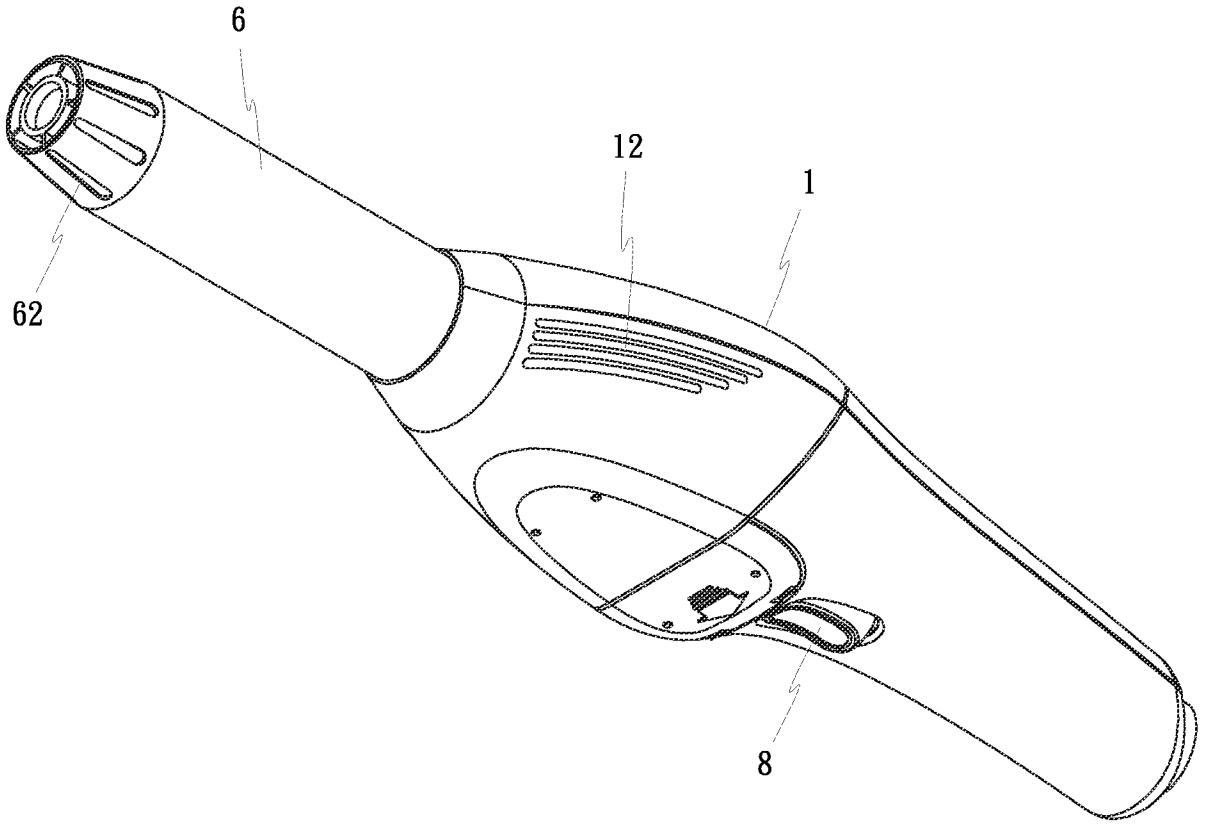
FIG. 3 is an oblique bottom elevational view of the cyclone ignition gun in accordance with the present invention.
Figure 4:
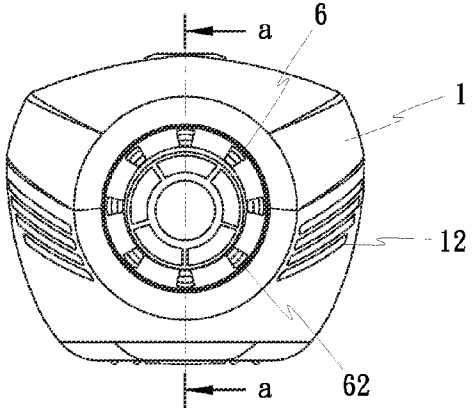
FIG. 4 is a front view of the cyclone ignition gun in accordance with the present invention.
Figure 5:
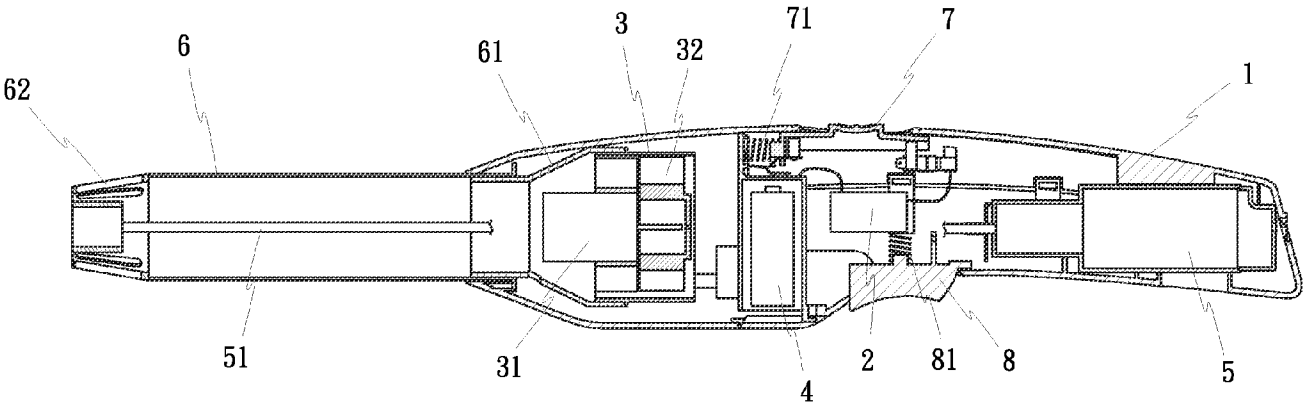
FIG. 5 is a sectional view taken along line a-a of FIG. 4.

Referring to FIGS. 1-5, a cyclone ignition gun in accordance with the present invention is shown. The cyclone ignition gun comprises a housing 1, and an igniter 2 and an electric fan 3 mounted in the housing 1. The housing 1 has mounted therein a battery pack 4, a gas can 5 and a duct pipe 6. Further, a slide switch 7 is mounted in a top side of the housing 1 for controlling the operation of the igniter 2 and the electric fan 3. Further, a slide switch 7 and a push switch 8 are respectively mounted in opposing top and bottom sides of the housing 1. The slide switch 7 is operable to control electronic ignition and to start the electric fan. The push switch 8 is operable to control gas intake. Simultaneously operating the slide switch 7 and the push switch 8 can selectively achieve the function of fire burning and air blowing, the function of fire burning, or the function of air blowing. Initiating the function of fire burning and air blowing can quickly ignite combustibles. The operation of this function is simple and labor-saving.

The aforesaid housing 1 can be made in any of a variety of shapes. Preferably, the housing 1 is formed of multiple shell members. As the configuration and fabrication of the housing is of the known art, no further detailed description in this regard will be necessary.

Referring to FIG. 2 again, the electric fan 3 comprises a motor 31 and a fan blade unit 32. The duct pipe 6 comprises a hood 61 located at a rear end thereof and attached to the air output side of the fan blade unit 32 (see FIG. 5) for collecting air outputted by the fan blade unit 32, and a plurality of air outlets 62 spaced around the periphery of an opposing front end thereof and suspending outside the housing 1 for producing a cyclone to strengthen flame burning. Further, the housing 1 has a plurality of air vents 12 cut through the peripheral wall thereof and aimed at the fan blade unit 32 for guiding in outside air during rotation of the fan blade unit 32.

The aforesaid slide switch 7 can be a composite switch, having a return spring 71 mounted at a front side thereof. The slide switch 7 is normally disposed in a middle position. Pushing the slide switch 7 forwardly from the middle position to a front-end position can start up the igniter 2 to ignite fire. Pushing the slide switch 7 backward from the middle position to a rear-end position can start up the electric fan 3 to blow air. When released the hand from the slide switch 7, the slide switch 7 is automatically returned to the middle position by elastic restoring force of the return spring 71 to turn off the igniter 2 and the electric fan 3.

Figure 6:
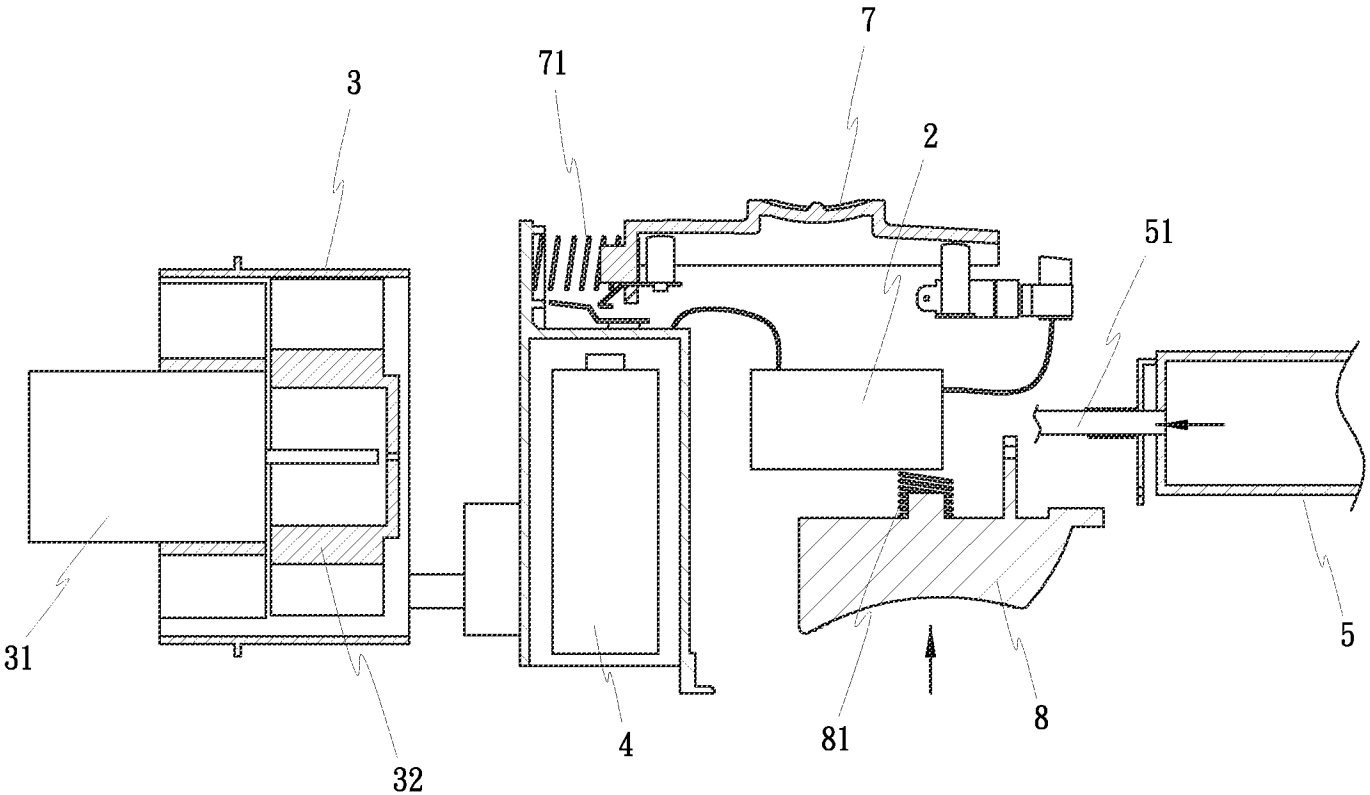
FIG. 6 is a schematic operational view of the present invention, illustrating the push switch pressed, and the gas can opened.
Figure 7:
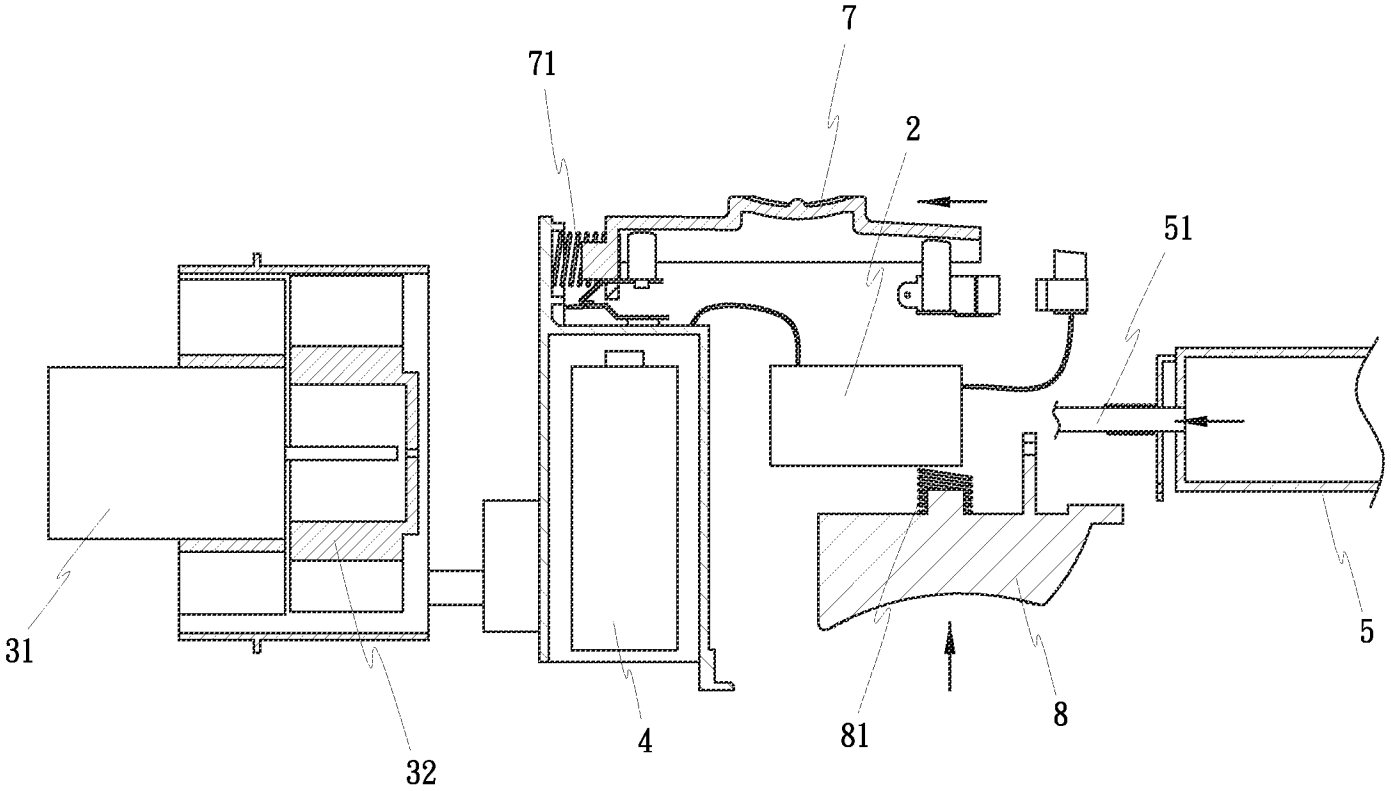
FIG. 7 is a schematic operational view of the present invention, illustrating the slide switch moved to the front-end position.
Figure 8:
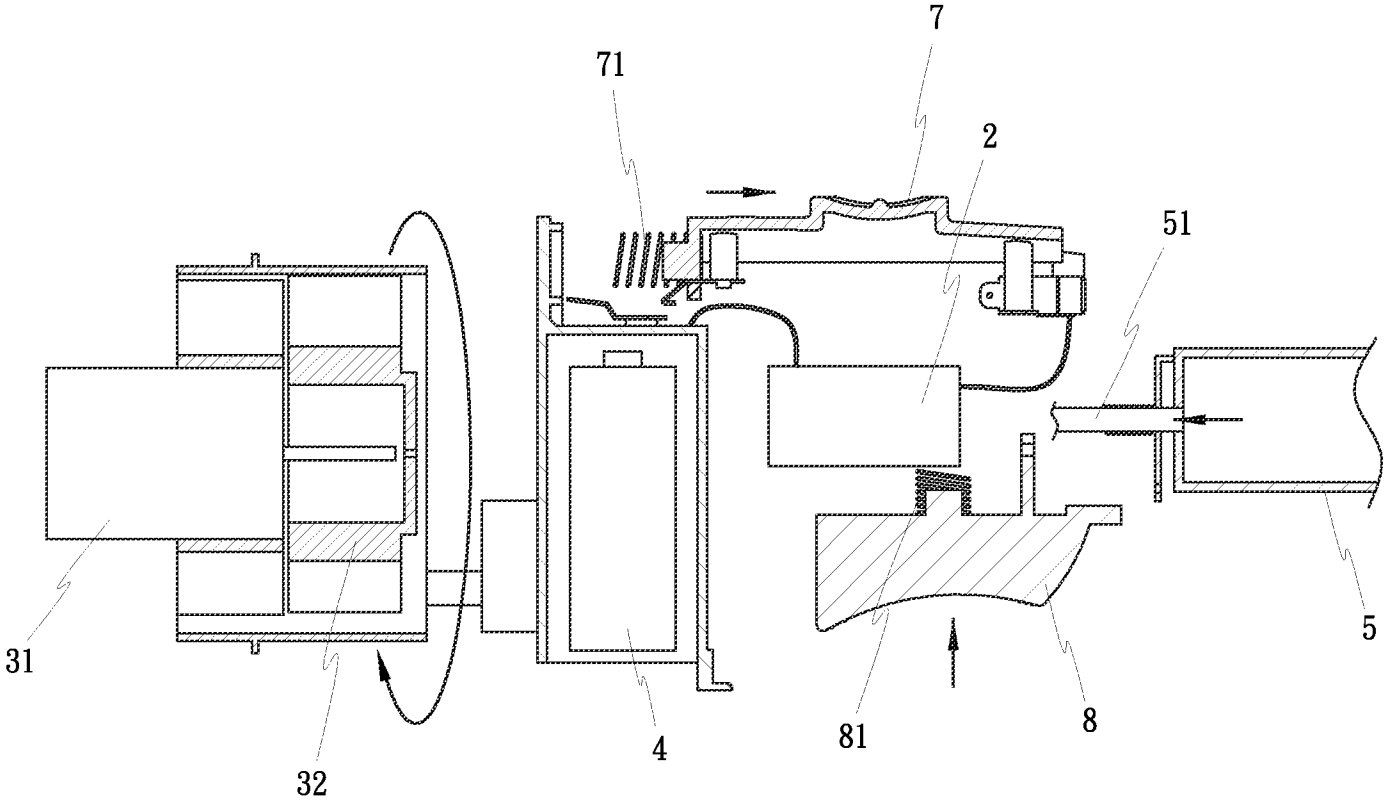
FIG. 8 is a schematic operational view of the present invention, illustrating the slide switch moved to the rear-end position and the push switch pressed.

Referring to FIG. 6, when using the cyclone ignition gun, press on the push switch 8 to open the valve of the gas can 5 for enabling gas to flow out of the gas can 5 through a gas nozzle 51 toward the output end of the cyclone ignition gun for burning. Thereafter, as shown in FIG. 7, push the slide switch 7 to the front-end position to complete the ignition work. After ignition, release the hand from the slide switch 7, enabling the slide switch 7 to be pushed back to the middle position by the return spring 71. At the initial stage in the ignition operation, combustible substances (charcoal, wood or coal, etc.) require a large amount of air (oxygen) for combustion. At this time, push the slide switch 7 to the rear-end position (see FIG. 8) to start up the electric fan 3 in inducing currents of air, and thus fire burning and air blowing are synchronously performed to quickly burn up the combustible substances. This operation is quite simple and labor-saving.

The aforesaid push switch 8 is equipped with a compression spring 81. Thus, the user must press the push switch 8 and hold it in the pressed condition so that the gas can 5 can be kept open to continuously supply gas for burning. When released the pressure from the push switch 8, the valve of the gas can 5 will be closed automatically to cut off the supply of gas. Therefore, the push switch 8 is a safety switch for controlling the supply of gas, preventing accidental gas discharge and assuring a high level of safety.

Figure 9:
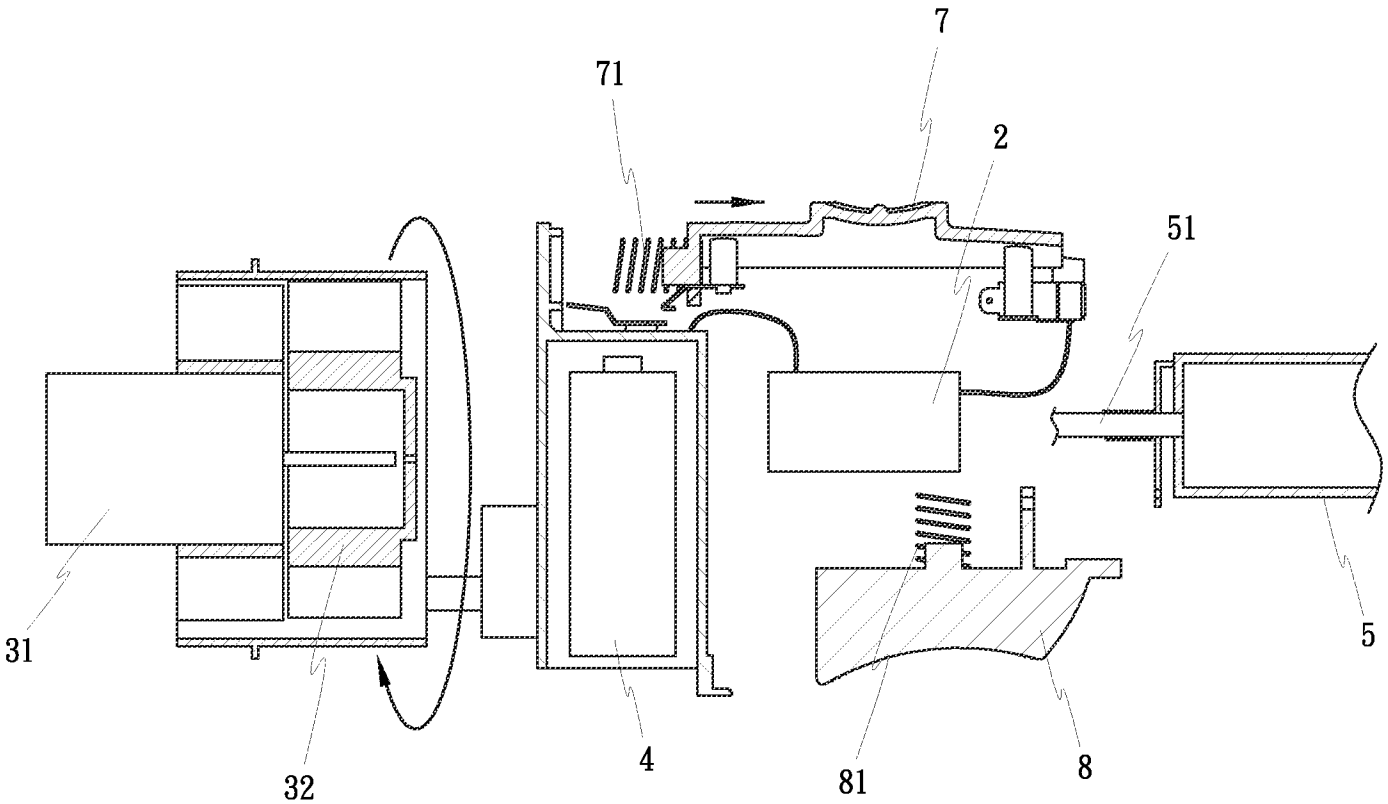
FIG. 9 a schematic operational view of the present invention, illustrating the slide switch moved to the rear-end position and the push switch released.

Referring to FIG. 9, the user can push the slide switch 7 backwardly to the rear-end position to start up the electric fan 3 without operating the push switch 8. At this time, the valve of the gas can 5 is closed, and only the electric fan 3 is working. Therefore, the invention can achieve the function of air blowing only.

What is claimed is:

1. A cyclone ignition gun, comprising a housing, an igniter mounted in said housing for igniting fire, and an electric fan mounted in said housing for inducing currents of air, wherein said housing houses a battery pack, a gas can and a duct pipe therein, and has a slide switch and a push switch respectively provided at opposing top and bottom sides thereof, said slide switch being operable to turn on/off said igniter and said electric fan, said push switch being operable to turn on/off said gas can, said slide switch and said push switch being simultaneously operable to control the operation of said igniter, said electric fan and said gas can in selectively achieving the function of fire burning and air blowing, the function of fire burning, or the function of air blowing, and wherein said electric fan comprises a motor and a fan blade unit;

said duct pipe comprises a hood located at a rear end thereof and attached to an air output side of said fan blade unit of said electric fan.

2. The cyclone ignition gun as claimed in claim 1, wherein said duct pipe has the rear end thereof mounted with said hood and attached to the air output side of said fan blade unit of said electric fan, and an opposing front end extending out of a front side of said housing.

3. The cyclone ignition gun as claimed in claim 2, wherein said duct pipe comprises a plurality of air outlets spaced around the periphery of the front end thereof.

4. The cyclone ignition gun as claimed in claim 1, wherein said housing comprises a plurality of air vents cut through a peripheral wall thereof and aimed at said fan blade unit.

5. A cyclone ignition gun, comprising a housing, an igniter mounted in said housing for igniting fire, and an electric fan mounted in said housing for inducing currents of air, wherein said housing houses a battery pack, a gas can and a duct pipe therein, and has a slide switch and a push switch respectively provided at opposing top and bottom sides thereof, said slide switch being operable to turn on/off said igniter and said electric fan, said push switch being operable to turn on/off said gas can, said slide switch and said push switch being simultaneously operable to control the operation of said igniter, said electric fan and said gas can in selectively achieving the function of fire burning and air blowing, the function of fire burning, or the function of air blowing, and wherein said slide switch is a composite switch for controlling the operation of said igniter and said electric fan.

6. A cyclone ignition gun, comprising a housing, an igniter mounted in said housing for igniting fire, and an electric fan mounted in said housing for inducing currents of air, wherein said housing houses a battery pack, a gas can and a duct pipe therein, and has a slide switch and a push switch respectively provided at opposing top and bottom sides thereof, said slide switch being operable to turn on/off said igniter and said electric fan, said push switch being operable to turn on/off said gas can, said slide switch and said push switch being simultaneously operable to control the operation of said igniter, said electric fan and said gas can in selectively achieving the function of fire burning and air blowing, the function of fire burning, or the function of air blowing, and wherein said push switch is supported on a compression spring in the bottom side of said housing.

7. The cyclone ignition gun as claimed in claim 5, wherein said electric fan comprises a motor and a fan blade unit; said duct pipe comprises a hood located at a rear end thereof and attached to an air output side of said fan blade unit of said electric fan.

8. The cyclone ignition gun as claimed in claim 7, wherein said duct pipe has the rear end thereof mounted with said hood and attached to the air output side of said fan blade unit of said electric fan, and an opposing front end extending out of a front side of said housing.

9. The cyclone ignition gun as claimed in claim 8, wherein said duct pipe comprises a plurality of air outlets spaced around the periphery of the front end thereof.

10. The cyclone ignition gun as claimed in claim 7, wherein said housing comprises a plurality of air vents cut through a peripheral wall thereof and aimed at said fan blade unit.

11. The cyclone ignition gun as claimed in claim 6, wherein said electric fan comprises a motor and a fan blade unit; said duct pipe comprises a hood located at a rear end thereof and attached to an air output side of said fan blade unit of said electric fan.

12. The cyclone ignition gun as claimed in claim 11, wherein said duct pipe has the rear end thereof mounted with said hood and attached to the air output side of said fan blade unit of said electric fan, and an opposing front end extending out of a front side of said housing.

13. The cyclone ignition gun as claimed in claim 12, wherein said duct pipe comprises a plurality of air outlets spaced around the periphery of the front end thereof.

14. The cyclone ignition gun as claimed in claim 11, wherein said housing comprises a plurality of air vents cut through a peripheral wall thereof and aimed at said fan blade unit.

* * * * *